US006261082B1

(12) United States Patent
Han

(10) Patent No.: US 6,261,082 B1
(45) Date of Patent: Jul. 17, 2001

(54) SELF-ALIGNING MANUAL DIE SET FOR PRESSING EXPLOSIVE POWDER INTO PELLETS

(75) Inventor: Phillip S. Han, Issue, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/606,163

(22) Filed: Jun. 29, 2000

(51) Int. Cl.[7] ..... B30B 11/04
(52) U.S. Cl. ..... 425/412; 264/3.4; 425/DIG. 15
(58) Field of Search ..... 264/3.4; 425/78, 425/DIG. 15, 412

(56) References Cited

U.S. PATENT DOCUMENTS

| | | | | |
|---|---|---|---|---|
| 3,156,011 | * | 11/1964 | Olson | 425/78 |
| 3,597,796 | | 8/1971 | Erlich . | |
| 3,606,637 | | 9/1971 | Lawless . | |
| 3,619,861 | | 11/1971 | Lumby . | |
| 3,790,330 | * | 2/1974 | Roland | 425/412 |
| 4,061,453 | | 12/1977 | DeSantis . | |
| 4,573,895 | | 3/1986 | DeSantis et al. . | |
| 4,759,886 | * | 7/1988 | Daugherity | 264/3.4 |
| 4,987,818 | * | 1/1991 | Alford | 264/8.4 |
| 5,277,570 | | 1/1994 | Siggers . | |

OTHER PUBLICATIONS

Mark D. Lowell, Manual Hydraulic Press Die Set Design, IHTR 1363, Mar. 15, 1991.

* cited by examiner

*Primary Examiner*—Robert Davis
(74) *Attorney, Agent, or Firm*—Mark Homer

(57) ABSTRACT

A manual die set for pressing explosive powder into pellets includes a ram, the ram having a head, a large diameter portion, a tapered portion, a small diameter portion and a pressing portion; a die defining an opening therethrough for receiving the ram, the opening including a large diameter portion, a tapered portion and a small diameter portion, the large diameter portion of the opening having a diameter less than or equal to about 0.002 inches larger than a diameter of the large diameter portion of the ram; a baseplate disposed in a bottom of the opening in the die; and a die holder for supporting the die and the baseplate when the manual die set is in a pressing configuration; wherein vertical alignment of the ram is maintained by insertion of the large diameter portion of the ram in the large diameter portion of the opening in the die.

13 Claims, 3 Drawing Sheets

SELF-ALIGNING MANUAL DIE SET FOR PRESSING EXPLOSIVE POWDER INTO PELLETS

STATEMENT OF GOVERNMENT INTEREST

The invention described herein may be manufactured and used by or for the Government of the United States of America for government purposes without the payment of any royalties therefor.

BACKGROUND OF THE INVENTION

The invention relates in general to manual die sets for pressing explosive powder and in particular to a self-aligning manual die set for pressing explosive powder into pellets.

Manual die sets for pressing explosive powder into pellets are known. The explosive powder is a highly sensitive explosive molding powder, for example, PBXN-9 or PBXW-11. The manual die set, in combination with a press for supplying the pressing force, presses the explosive powder into solid cylindrical pellets.

FIG. 1 is an elevation view, partially in cross-section, of a known manual die set 10 in a press configuration and FIG. 2 is an elevation view, partially in cross-section, of the known manual die set 10 of FIG. 1 in a knockout configuration. Manual die set 10 includes a die 12 with an opening 14 therethrough, a ram 16 having a head 18, a baseplate 22 that fits in the bottom of the opening 14 in die 12 and a knockout ring 24.

Manual die set 10 is used to press highly sensitive explosive molding powder 20 into a pressed pellet 26 in the following manner. First, the baseplate 22 is fitted into the opening 14 in the bottom of the die 12. The required amount of molding powder 20 is poured into the die opening 14. Next, the ram 16 is inserted into the top of the die opening 14 and allowed to "float" down as its weight forces air out of opening 14. Air escapes through the limited clearance between the ram 16 and the die wall until the ram 16 rests on the surface of the powder 20.

Next, the die set 10 is placed under a pressing mechanism (not shown), such as a hydraulic ram, and press force is applied to the ram head 18 for a required dwell time. After pressing, the die set 10 is lifted and placed on top of the knockout ring 24. If the baseplate 22 is loose, it is usually removed before the die is placed on the knockout ring 24. Finally, the ram 16 is pressed completely down, ejecting the baseplate 22 (if not previously removed) and the pressed pellet 26 into the cavity in the knockout ring 24. Usually, a small piece of wadding or foam rubber (not shown) is inserted in the bottom of the knockout ring 24 to cushion the landing of the baseplate 22 and/or pellet 26.

FIG. 3 is an elevation view, partially in cross-section, of the manual die set 10 of FIG. 1 showing an alignment problem. The amount of misalignment shown in FIG. 3 is somewhat exaggerated to illustrate the problem. While pressing pellets using the manual die set 10, it is difficult to align the ram 16 vertically in the die 12. Also, the ram 16 may become cocked in the die 12 when the pressing pressure builds up. The lack of vertical alignment causes a high shear stress area 17 with safety problems where the edge of the ram 16 touches the die wall. First, the ram 16 may cause galling of the interior wall of the die 12, requiring replacement of the die. Second, the ram 16 may pinch some of the powder 20 against the die, which may cause an explosion. Third, as the pellet 26 is ejected, the ram 16 can shear off the explosive residue on the inside surface of the die 12, resulting in an explosion. These are serious safety problems when pressing highly sensitivity explosive molding powder.

Thus, a need exists for a manual die set that overcomes the problems of the manual die set of FIGS. 1–3.

SUMMARY OF THE INVENTION

The present invention provides a manual die set, comprising a ram, the ram having a head, a large diameter portion, a tapered portion, a small diameter portion and a pressing portion; a die defining an opening therethrough for receiving the ram, the opening including a large diameter portion, a tapered portion and a small diameter portion, the large diameter portion of the opening having a diameter less than or equal to about 0.002 inches larger than a diameter of the large diameter portion of the ram; a baseplate disposed in a bottom of the opening in the die; and a die holder for supporting the die and the baseplate when the manual die set is in a pressing configuration; wherein vertical alignment of the ram is maintained by insertion of the large diameter portion of the ram in the large diameter portion of the opening in the die.

Explosive molding powder is disposed in the opening in the die between the pressing portion of the ram and the baseplate.

The manual die set further comprises a knockout ring for supporting the die when the manual die set is in a knockout configuration.

When the manual die set is in the knockout configuration and the ram is fully inserted in the opening in the die, the tapered portion of the ram and the tapered portion of the die define a gap therebetween.

Preferably, the die includes a bottom surface and an external surface, the bottom surface including at least one groove extending from the opening in the die to the external surface of the die, for passage of air therethrough. The die holder includes a base portion and an upwardly extending portion, the upwardly extending portion preferably includes at least one opening therethrough for passage of air.

More preferably, the large diameter portion of the ram includes a groove formed therein and the external surface of the die includes a groove formed therein, the manual die set further comprising an O-ring disposed in the groove in the large diameter portion of the ram and a second O-ring disposed in the groove in the external surface of the die.

Further objects, features and advantages of the invention will become apparent from the following detailed description taken in conjunction with the following drawing.

BRIEF DESCRIPTION OF THE DRAWING

Throughout the Figures, reference numerals that are the same refer to the same features.

DETAILED DESCRIPTION OF THE PREFERRED EMBODIMENTS

The present invention is used to press highly sensitive explosive molding powder, especially explosive molding powder with a very high frictional sensitivity, into cylindrical pellets. The invention minimizes the shear force between the ram and the die during the pressing operation, thereby minimizing the chance of an explosive pressing incident.

Figure 3:
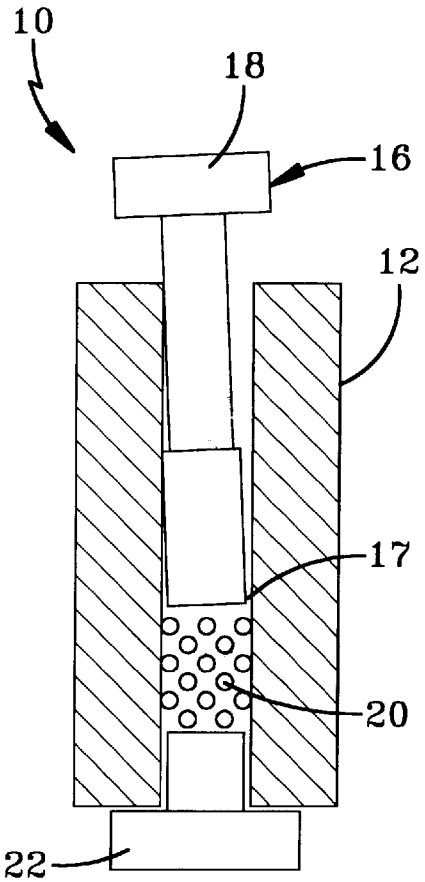
FIG-3 PRIOR ART
FIG. 3 is an elevation view, partially in cross-section, of the manual die set of FIGS. 1 and 2 showing an alignment problem.
Figure 2:
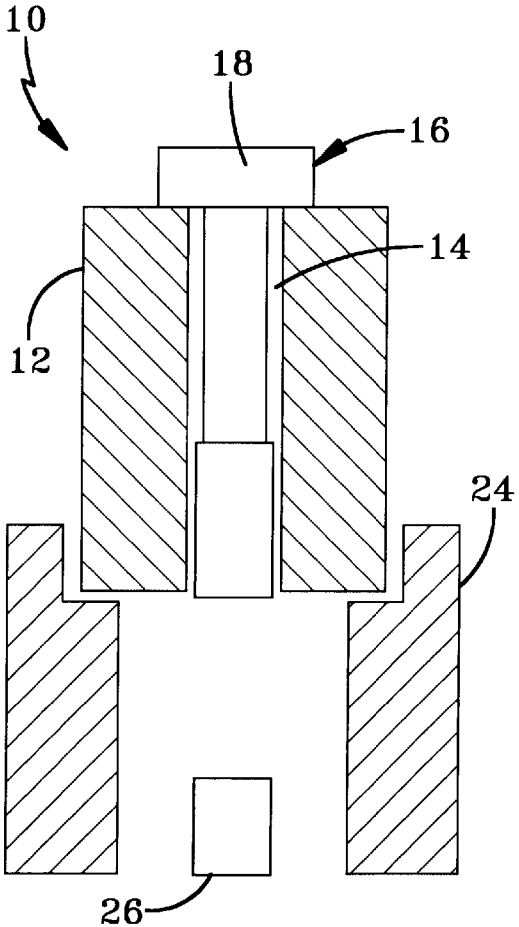
FIG-2 PRIOR ART
FIG. 2 is an elevation view, partially in cross-section, of a known manual die set in a knockout configuration.
Figure 1:
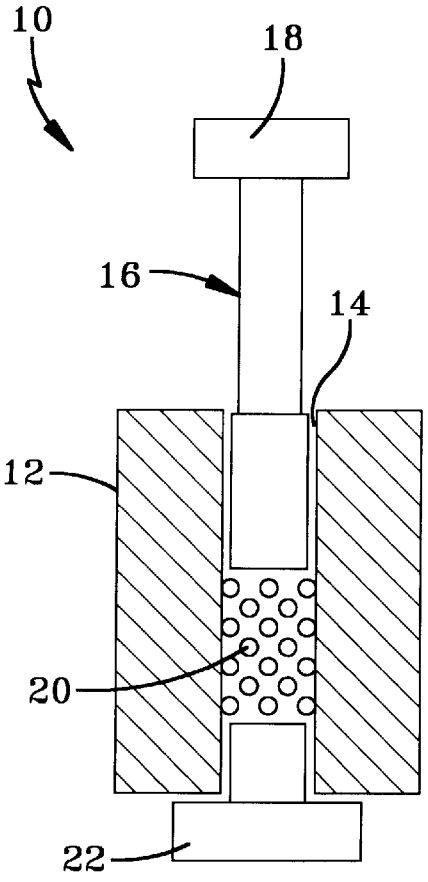
FIG-1 PRIOR ART
FIG. 1 is an elevation view, partially in cross-section, of a known manual die set in a press configuration.

To minimize the shear force between the ram and the die during pressing, the ram must be as close to perfectly vertically aligned in the die as possible. Problems arise when the ram is cocked with respect to the die (see FIG. 3). The present invention minimizes the cocking of the ram during pressing by using a "ram guide" at the top of the ram. The invention reduces additional shear force between the ram and die during pressing and ejecting procedures.

Figure 5:
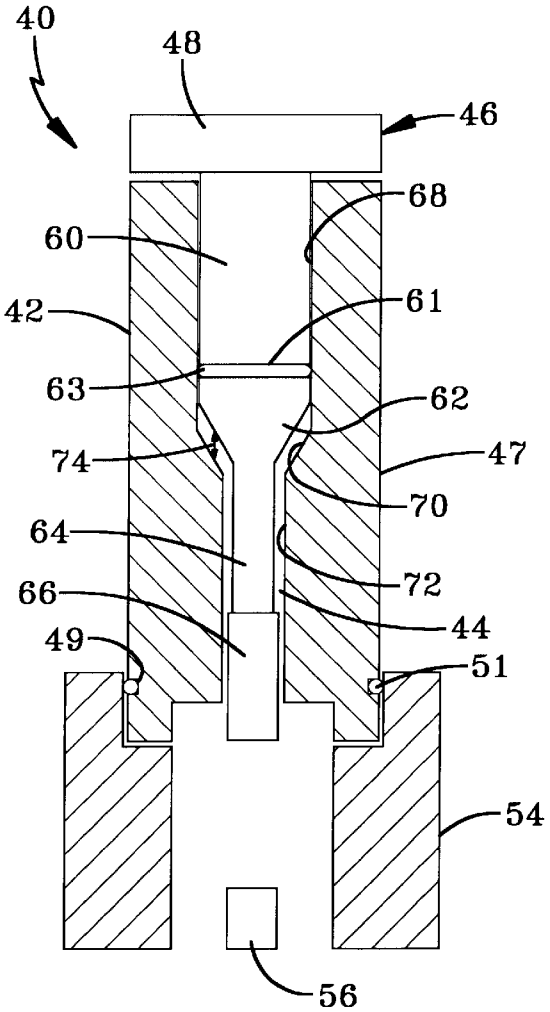
FIG. 5 is an elevation view, partially in cross-section, of the manual die set of FIG. 4, in a knockout configuration.
Figure 4:
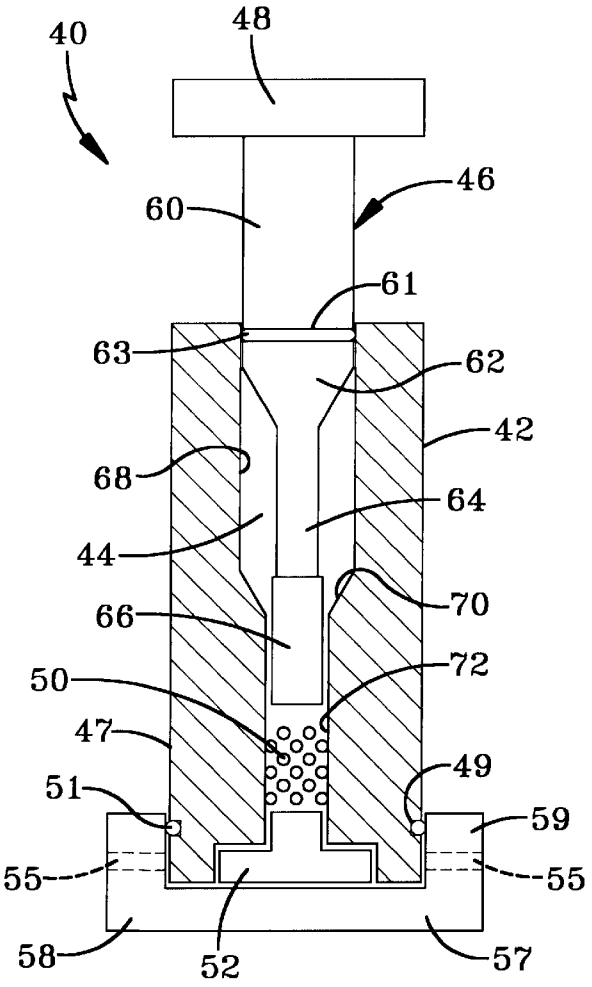
FIG. 4 is an elevation view, partially in cross-section, of an embodiment of a self-aligning manual die set in accordance with the invention, in a press configuration.

FIG. 4 is an elevation view, partially in cross-section, of an embodiment of a self-aligning manual die set 40 in accordance with the invention, in a press configuration. FIG. 5 is an elevation view, partially in cross-section, of the manual die set 40 of FIG. 4, in a knockout configuration. In the press configuration of FIG. 4, the manual die set 40 includes a ram 46, a die 42, a baseplate 52 and a die holder 58. The ram 46 includes a head 48, a large diameter portion 60, a tapered portion 62, a small diameter portion 64 and a pressing portion 66.

The die 42 defines an opening 44 therethrough for receiving the ram 46. The opening 44 includes a large diameter portion 68, a tapered portion 70 and a small diameter portion 72. The large diameter portion 60 of the ram 46 functions as a "ram guide" to prevent the ram 46 from cocking in the opening 44 in the die 42. Vertical alignment of the ram 46 is maintained by insertion of the large diameter portion 60 of the ram 46 in the large diameter portion 68 of the opening 44 in the die 42. The large diameter portion 68 of the opening 44 in the die 42 has a diameter less than or equal to about 0.002 inches larger than a diameter of the large diameter portion 60 of the ram 46. Preferably, the large diameter portion 68 of the opening 44 in the die 42 has a diameter less than or equal to about 0.0015 inches larger than a diameter of the large diameter portion 60 of the ram 46. Additionally, a diameter of the small diameter portion 72 of the opening 44 in the die is less than or equal to about 0.002 inches larger than a diameter of the pressing portion 66 of the ram.

The baseplate 52 is disposed in a bottom of the opening 44 in the die 42. The die holder 58 supports the die 42 and the baseplate 52 when the manual die set 40 is in a pressing configuration as shown in FIG. 4. The explosive molding powder 50 is disposed in the small diameter portion 72 of the opening 44 in the die 42 between the pressing portion 66 of the ram and the baseplate 52.

As shown in FIG. 5, the manual die set 40 further comprises a knockout ring 54 for supporting the die 42 when the manual die set 40 is in a knockout configuration. When the manual die set 40 is in the knockout configuration and the ram 46 is fully inserted in the opening 44 in the die, the tapered portion 62 of the ram and the tapered portion 70 of the opening in the die define a gap 74 therebetween. The gap 74 is necessary in case some explosive molding powder 50 has stuck to the die at the tapered portion 70 of the opening 44. If there were no gap 74, it is possible that an explosion would occur when the tapered portion 62 of the ram compresses powder residue against the wall of the die 42. The vertical dimension of the gap 74 is in the range of about 0.050 inches to about 0.1 inches.

The ram 46, die 42, baseplate 52, die holder 58 and knockout ring 54 are all made of hardened tool steel. A conventional press, for example, a hydraulic press (not shown) is used to provide the pressing force against the head 48 of the ram. Depending on the size of the manual die set 40, the press may be a 100 to 200 ton press. The head 48 of the ram receives between about 15 and 30 kpsi of pressing force.

Figure 6:
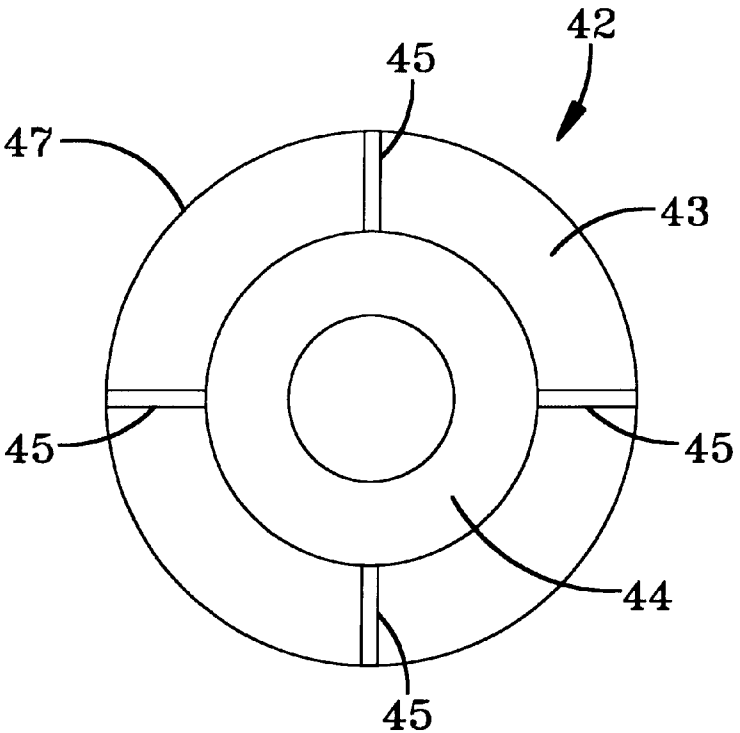
FIG. 6 is a bottom view of a die.

FIG. 6 is a bottom view of the die 42. To allow for the escape of air from the die opening 44 during the pressing operation, the bottom surface 43 of the die 42 includes at least one groove 45 extending from the opening 44 in the die to the external surface 47 of the die 42. Preferably, four grooves 45 are spaced substantially equally around the circumference of the bottom surface 43 of the die 42. The size of a groove 45 is, for example, about 0.030 inches wide and 0.030 inches deep. So that air may pass between the baseplate 52 and the die 42 to get to the grooves 45, a gap between the baseplate 52 and the die 42 is, for example, about 0.00075 inches.

As shown in FIG. 4, the die holder 58 includes a base portion 57 and an upwardly extending portion 59. The upwardly extending portion 59 includes at least one opening 55 for passage of air from the at least one groove 45 to the exterior of the die set 40. Preferably, the upwardly extending portion 59 includes two openings 55 located 180 degrees apart. The diameter of the openings 55 is, for example, about 0.125 inches. Thus, as the ram 46 is descending in the die opening 44, air may flow from the opening 44 around the baseplate 52 to one of the grooves 45 and then to openings 55 where the air exits the die set 40.

In some applications, it is desirable to provide a vacuum environment in the opening 44 in the die 42 when the powder is being pressed. To accomplish this, the large diameter portion 60 of the ram 46 includes a groove 61 formed therein and an O-ring 63 disposed in the groove for sealing the opening 44. Also, the external surface 47 of the die 42 includes a groove 49 formed therein and an O-ring 51 disposed in the groove 49 for sealing the external surface 47 of the die 42 against the die holder 58.

Figure 7:
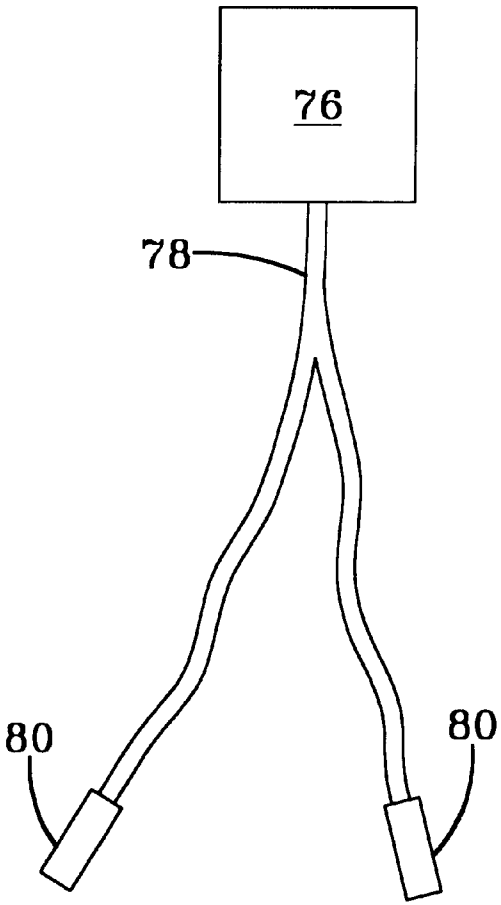
FIG. 7 is a schematic drawing of a vacuum pump and hose.

To produce the vacuum, a vacuum pump 76 (FIG. 7) is connected via a vacuum hose 78 and a quick-connect coupling 80 to the openings 55 in the upwardly extending portion 59 of the die holder 58. The vacuum produced by the vacuum pump 76 is, for example, about 2 to 5 mm Hg.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A manual die set, comprising:

a ram, the ram having a head, a large diameter portion, a tapered portion, a small diameter portion and a pressing portion;

a die defining an opening therethrough for receiving the ram, the opening including a large diameter portion, a tapered portion and a small diameter portion, the large diameter portion of the opening having a diameter less than or equal to about 0.002 inches larger than a diameter of the large diameter portion of the ram;

a baseplate disposed in a bottom of the opening in the die; and a die holder for supporting the die and the baseplate when the manual die set is in a pressing configuration;

wherein vertical alignment of the ram is maintained by insertion of the large diameter portion of the ram in the large diameter portion of the opening in the die.

2. The manual die set of claim 1 further comprising explosive molding powder disposed in the opening in the die between the pressing portion of the ram and the baseplate.

3. The manual die set of claim 1 further comprising a knockout ring for supporting the die when the manual die set is in a knockout configuration.

4. The manual die set of claim 3 wherein when the manual die set is in the knockout configuration and the ram is fully inserted in the opening in the die, the tapered portion of the ram and the tapered portion of the die define a gap therebetween.

5. The manual die set of claim 1 wherein the large diameter portion of the opening has a diameter less than or equal to about 0.0015 inches larger than a diameter of the large diameter portion of the ram.

6. The manual die set of claim 4 wherein a vertical dimension of the gap is in the range of about 0.050 inches to about 0.1 inches.

7. The manual die set of claim 1 wherein a diameter of the small diameter portion of the opening in the die is less than or equal to about 0.002 inches larger than a diameter of the pressing portion of the ram.

8. The manual die set of claim 1 wherein the die includes a bottom surface and an external surface, the bottom surface including at least one groove extending from the opening in the die to the external surface of the die, for passage of air therethrough.

9. The manual die set of claim 8 wherein the at least one groove comprises four grooves spaced substantially equally around a circumference of the bottom surface of the die.

10. The manual die set of claim 8 wherein the die holder includes a base portion and an upwardly extending portion, the upwardly extending portion including at least one opening therethrough for passage of air.

11. The manual die set of claim 10 wherein the large diameter portion of the ram includes a groove formed therein and the external surface of the die includes a groove formed therein, the manual die set further comprising an O-ring disposed in the groove in the large diameter portion of the ram and a second O-ring disposed in the groove in the external surface of the die.

12. The manual die set of claim 11 further comprising a vacuum hose and a vacuum pump, the vacuum hose being connected at one end to the at least one opening in the upwardly extending portion of the die holder and at another end to the vacuum pump.

13. The manual die set of claim 12 wherein a vacuum produced by the vacuum pump is about 2 to 5 mm Hg.

* * * * *